US005941740A

United States Patent [19]

Neuer et al.

[11] Patent Number: 5,941,740

[45] Date of Patent: Aug. 24, 1999

[54] ELECTRICAL TERMINAL

[75] Inventors: Gregg D. Neuer, Huntington; Steven K. Heckman, Fort Wayne, both of Ind.

[73] Assignee: UT Automotive Dearborn, Inc., Dearborn, Mich.

[21] Appl. No.: 08/776,362

[22] PCT Filed: Jul. 27, 1994

[86] PCT No.: PCT/US94/08653

§ 371 Date: Sep. 2, 1997

§ 102(e) Date: Sep. 2, 1997

[87] PCT Pub. No.: WO96/03786

PCT Pub. Date: Feb. 8, 1996

[51] Int. Cl.[6] ..... H01R 11/22

[52] U.S. Cl. ..... 439/852

[58] Field of Search ..... 439/852, 862, 439/850

[56] References Cited

U.S. PATENT DOCUMENTS

| | | | |
|---|---|---|---|
| 3,139,318 | 6/1964 | Binder et al. | 439/850 |
| 3,486,160 | 12/1969 | Wallace, Jr. . | |
| 3,644,872 | 2/1972 | Russo, Jr. | 439/849 |
| 3,713,080 | 1/1973 | Kennedy . | |
| 3,894,785 | 7/1975 | Hubner et al. . | |
| 3,917,377 | 11/1975 | Hall et al. . | |
| 3,932,013 | 1/1976 | Yeager et al. . | |
| 3,947,959 | 4/1976 | DuRocher . | |
| 4,135,226 | 1/1979 | Kourimsky . | |
| 4,212,509 | 7/1980 | Brooks et al. . | |
| 4,255,004 | 3/1981 | Kourimsky et al. . | |
| 4,451,109 | 5/1984 | Inoue . | |
| 4,460,239 | 7/1984 | Inoue . | |
| 4,531,808 | 7/1985 | Cairns et al. . | |
| 4,550,972 | 11/1985 | Romak . | |
| 4,602,834 | 7/1986 | Hahn et al. . | |
| 4,657,336 | 4/1987 | Johnson et al. | 439/852 |
| 4,666,227 | 5/1987 | Galizia et al. . | |
| 4,689,718 | 8/1987 | Maue et al. . | |
| 4,699,444 | 10/1987 | Isohata . | |
| 4,703,397 | 10/1987 | Minoura et al. . | |
| 4,707,050 | 11/1987 | Konnenmann . | |
| 4,717,359 | 1/1988 | Rahrig et al. . | |
| 4,792,307 | 12/1988 | Stewart, Sr. . | |
| 4,798,545 | 1/1989 | Roy et al. . | |
| 4,850,884 | 7/1989 | Sawai et al. . | |
| 4,988,316 | 1/1991 | Roy . | |
| 5,004,438 | 4/1991 | Cabourne . | |
| 5,032,090 | 7/1991 | Roy . | |
| 5,057,026 | 10/1991 | Sawai et al. . | |
| 5,106,324 | 4/1992 | Natsume . | |
| 5,106,329 | 4/1992 | Maeshima et al. . | |
| 5,131,873 | 7/1992 | Gierut et al. . | |
| 5,135,418 | 8/1992 | Hatagishi et al. . | |
| 5,148,596 | 9/1992 | Zahn . | |
| 5,209,680 | 5/1993 | Fry . | |
| 5,308,267 | 5/1994 | Hotea . | |
| 5,360,356 | 11/1994 | May et al. . | |
| 5,478,244 | 12/1995 | Maue et al. . | |
| 5,655,927 | 8/1997 | Maue et al. | 439/852 |
| 5,690,518 | 11/1997 | Roy et al. . | |

FOREIGN PATENT DOCUMENTS

| | | |
|---|---|---|
| 0 508 484 A2 | 10/1992 | European Pat. Off. . |
| 1539393 | 10/1967 | France . |
| 2 378 377 | 8/1978 | France . |
| 2 589 637 | 5/1987 | France . |
| 1 565 973 | 3/1966 | Germany . |
| 2 050 758 | 10/1970 | Germany . |
| 24 09 660 | 9/1975 | Germany . |
| 83 30 470 U | 2/1985 | Germany . |
| 34 18249 A1 | 11/1985 | Germany . |
| 88 04 092 U | 6/1988 | Germany . |
| 39 06 667 A1 | 9/1989 | Germany . |
| 1 319 059 | 5/1973 | United Kingdom . |

*Primary Examiner*—Gary F. Paumen
*Assistant Examiner*—Briggitte R Hammond
*Attorney, Agent, or Firm*—Harness, Dickey & Pierce, P.L.C.

[57] ABSTRACT

An electrical terminal (20) has an electrically conductive beam (40) flexibly coupled to a wall (22). The beam (40) has a pair of outboard shoulders (42) and a tongue (44) flexibly disposed therebetween.

18 Claims, 4 Drawing Sheets

20
170
172
160
162
164
180
182

ELECTRICAL TERMINAL

BACKGROUND OF THE INVENTION

This invention relates generally to electrical terminals and specifically to an automotive electrical terminal exhibiting low insertion efforts.

In automotive vehicle electrical systems, it is common to have electrical connectors between a pair of discrete wires. It is also known to provide electrical connectors between a discrete wire and a male conductive blade or even between a pair of male conductive blades. These traditional electrical connectors may have a barrel or box-like shape for receiving a male member. Examples of such traditional electrical connectors are disclosed within the following U.S. Pat. No. 4,798,545 entitled "Electrical Terminal Receptacle and Electrical Component Housing Adapted for the Same" which issued to Roy et al. on Jan. 17, 1989; U.S. Pat. No. 4,531,808 entitled "Blade Coupling Terminal" which issued to Cairns et al. on Jul. 30, 1985; U.S. Pat. No. 4,460,239 entitled "Connector Terminal" which issued to Inoue on Jul. 17, 1984; U.S. Pat. No. and 4,451,109 entitled "Connector Terminal" which issued to Inoue on May 29, 1984. The disclosures of these patents are incorporated by reference herewithin.

Another electrical connector construction that has been employed within the automotive industry consists of four side walls folded in a box-like manner and having a conductive tail extending therefrom, the conductive tail can be crimped onto a discrete wire. A pair of flexible beams project within the box from respective facing walls. Each beam is substantially flat with a single central slot extending the majority of the beam's longitudinal length.

Conventional electrical connectors have many limitations. The blade formations of these conventional constructions cause high insertion efforts of a male blade therein. The male blade compresses each beam beyond the plastic elasticity of the material such that each blade is then given a permanent compressed set. Thus, the male blade can inadvertently disengage from the female electrical connector. Furthermore, these traditional electrical connectors are prone to oxidation thereby creating a poor electrical contact.

SUMMARY OF THE INVENTION

In accordance with the present invention, the preferred embodiment of an electrical terminal has an electrically conductive beam flexibly coupled to a conductive wall. The beam further has a pair of outboard shoulders and a tongue flexibly disposed therebetween. In another aspect of the present invention, a pair of beams, each having a tongue and a pair of outboard shoulders, are oppositely facing one another in a box electrical terminal. The electrical terminal of the present invention is preferably employed in an automotive vehicle electrical system.

The electrical terminal of the present invention is advantageous over traditional constructions in that the beams of the present invention provide for low insertion efforts of a mating conductive member without allowing the beams to be deformed beyond their desired plastic elasticity. Also, low but predictable removal forces of the mating member are achieved. An oxidation and debris wiping action is created between the mating member and the beam of the present invention during removal of the mating member from the female electrical terminal. The present invention electrical terminal further provides a large target area for the mating member while preventing undesirable lateral rotation or angular insertion therein. The beam of the present invention electrical terminal is designed to mechanically and electrically contact the male member during the initial installation therein as well as providing for a large electrical contact area when fully inserted. The electrical terminal of the present invention also creates a shortened electrical path when the male member is fully installed. Additional advantages and features of the present invention will become apparent from the following description and appended claims, taken in conjunction with the accompanying drawings.

DETAILED DESCRIPTION OF THE PREFERRED EMBODIMENT

Figure 1:
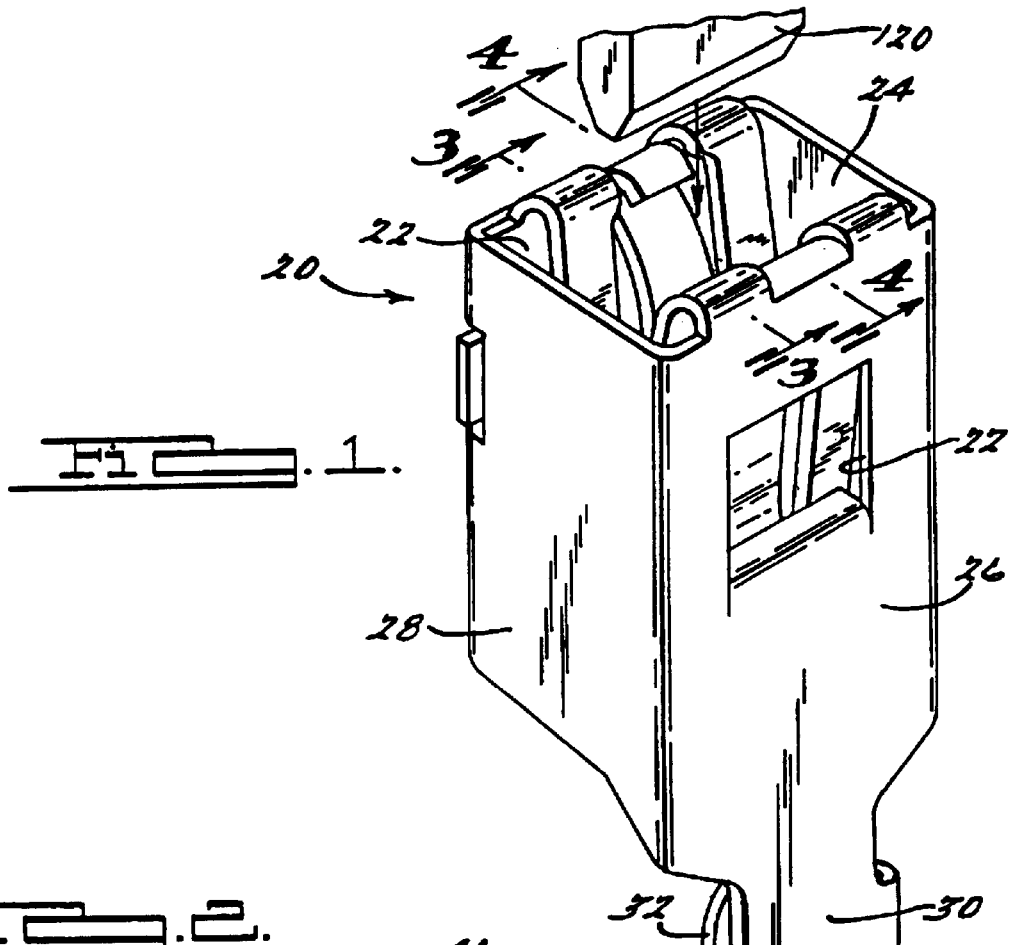
FIG. 1 is a perspective view showing a preferred embodiment of an electrical terminal of the present invention.

The preferred embodiment of an electrical terminal 20 of the present invention is shown in FIG. 1. The present invention electrical terminal 20 is preferably a female box type connector defined by four walls 22, 24, 26 and 28. A tail 30 projects longitudinally downward from wall 26. Tail 30 has a plurality of tabs 32 which are crimped around a stripped end of an insulated discrete copper wire 34.

Figure 2:
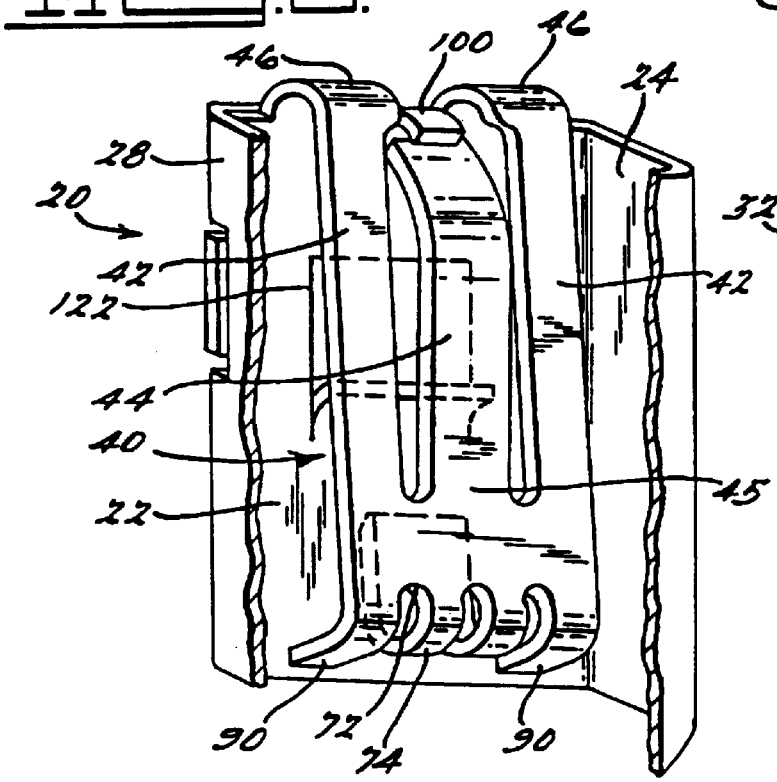
FIG. 2 is a perspective view, partially broken away, showing the preferred embodiment of the present invention electrical terminal of FIG. 1.
Figure 3:
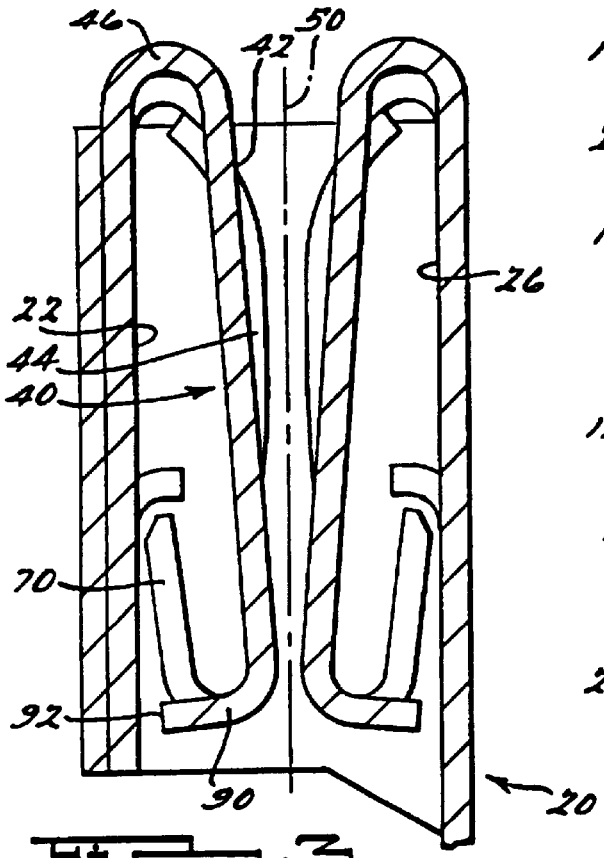
FIG. 3 is a sectional view, taken along line 3—3 of FIG. 1, showing the preferred embodiment of the present invention electrical terminal.
Figure 4:
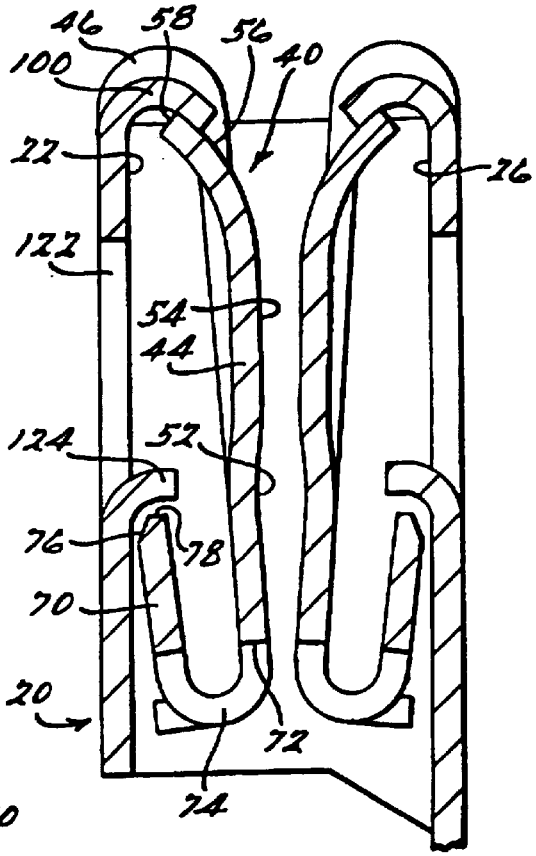
FIG. 4 is a sectional view, taken along line 4—4 of FIG. 1, showing the preferred embodiment of the present invention electrical terminal.

Since the box portion of the preferred embodiment electrical terminal 20 is substantially in mirrored symmetry, only the portion adjacent to wall 22 will be discussed in detail hereinafter. As can best be observed in FIGS. 2 through 4, a beam 40 is defined by a pair of outboard shoulders 42 with a tongue 44 flexibly coupled thereto at a proximal portion 45 thereof. Shoulders 42 are flexibly coupled to wall 22 by lead-in bends 46. When in its nominal state (as is shown in FIG. 3) each shoulder 42 is angled away from a longitudinal axis 50 by approximately 4°. Tongue 44 has a first curved portion 52, a flat median portion 54 and a recurved portion 56. A distal edge 58 of tongue 44 points substantially toward wall 22 proximate with bend 46. Flat portion 54 is oriented at an angle of 1° from longitudinal axis 50.

A return leg 70 is flexibly joined to a distal end 72 of beam 40 by a bifurcated bend 74. A taper 76 is disposed along a lateral corner of leg 70 adjacent to an edge 78 thereof. This prevents galling of wall 22 when leg 70 is compressed thereagainst. A pair of return stops 90 project from distal end 72 of beam 40. An edge 92 of each return stop 90 serves to abut against wall 22 to prevent overcompression of beam 40.

A tongue retainer 100 is bent from wall 22 between lead-in bends 46. Tongue retainer 100 covers distal end 58 of tongue 44. Tongue retainer 100 relieves the lead-in bends 46 thereby allowing easier flexure of shoulders 42. Tongue retainer 100 further holds tongue 44 in place when a male blade 120 (see FIG. 5) is fully installed. Tongue retainer 100 additionally protects tongue 44 from damage during initial male blade 120 (see FIG. 5) insertion. A window 122 is also cut within wall 22 and a portion 124 of wall 22 is inwardly upset therefrom.

Electrical terminal 20 of the present invention is preferably made from copper alloy grade CA197 but may alternately be made from a brass alloy such as CA260. The present invention electrical terminal 20 is preferably stamped in a flat sheet and then inwardly folded by use of progressive dies and metal scoring.

Figure 5:
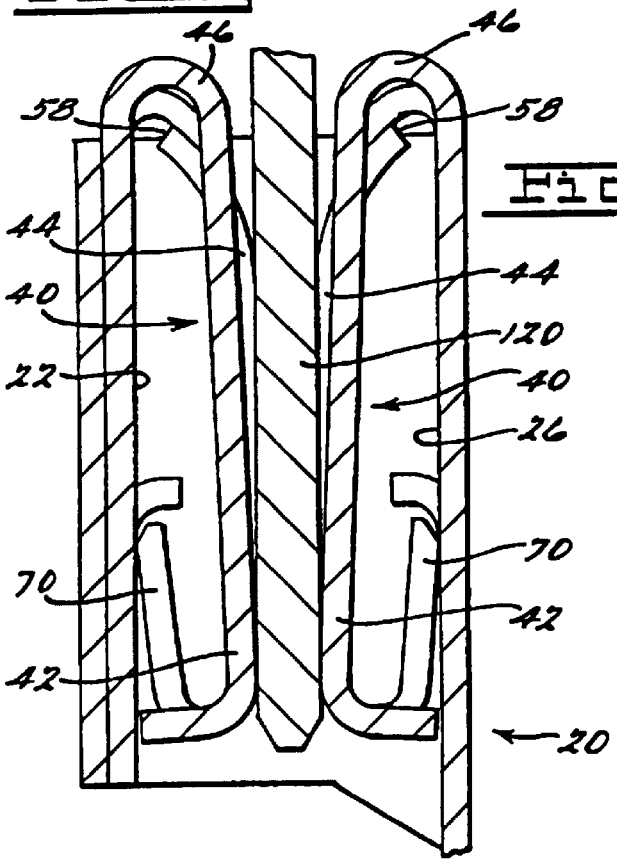
FIG. 5 is a sectional view, similar to that of FIG. 3, showing a male blade inserted within the preferred embodiment of the present invention electrical terminal.

Referring now to FIG. 5, male blade 120 is insertable between the pair of beams 40. First, male blade 120 is guided into electrical terminal 20 by lead-in bends 46. Then, male blade 120 engages and pivots tongues 44 about their proximal portions 45. This causes distal ends 58 of tongues 44 to outwardly compress toward their respective walls 22 and 26. As male blade 120 continues its downward insertion, it engages shoulders 42 so as to provide a counter moment to each beam 40. Coincidentally, return legs 70 are then compressed against walls 22 and 26 so as to provide a shortened electrical path between blades 40 and walls 22 and 26. This will reduce the electrically harmful effect of oxidation and corrosion upon beams 40.

Figure 7:
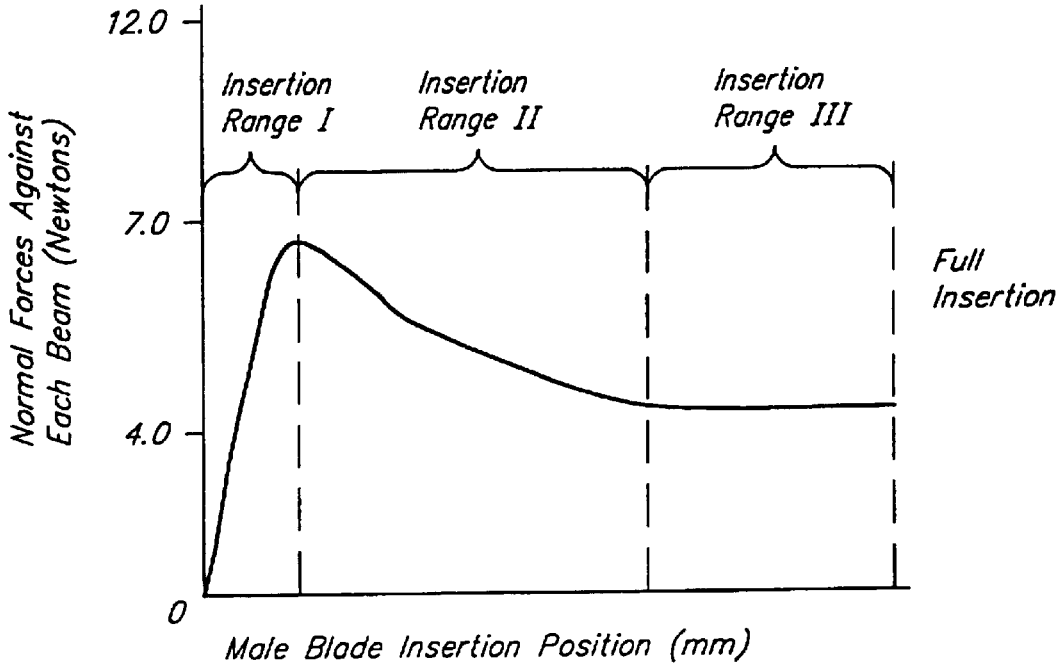
FIG. 7 is a graph depicting the insertion forces of the male blade into the preferred embodiment electrical terminal of the present invention of FIG. 1.
Figure 8:
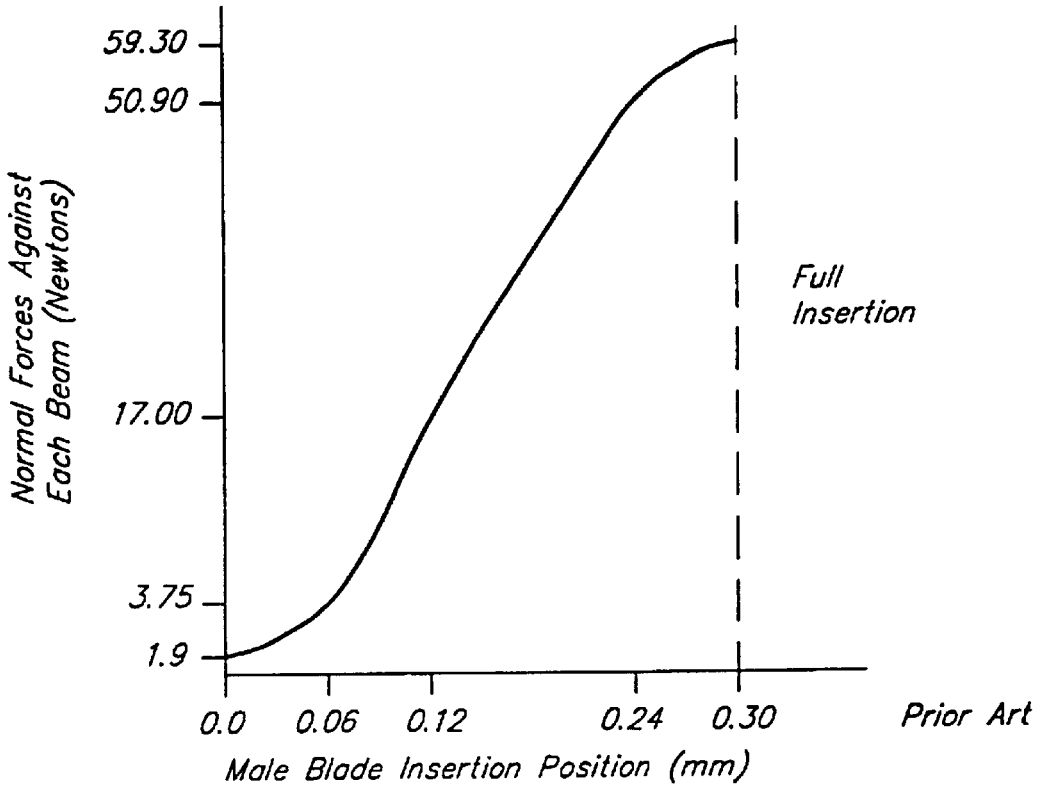
FIG. 8 is a graph depicting the insertion forces of a male blade into a prior art electrical connector.

The forces required to insert male blade 120 into the preferred embodiment of the present invention electrical terminal 20 are graphically illustrated in FIG. 7. Insertion range I defines the initial engagement of the male blade with the recurved and median portions of the tongue. This creates a first pivotal moment of the tongue. Insertion range II depicts the counter moment of the male blades' engagement with the shoulders. Insertion range III depicts the counter balancing a neutralizing of moment forces between the tongues and the adjacent shoulders through full insertion of the male blade. This can be contrasted to the prior art insertion efforts shown in FIG. 8. The present invention electrical terminal is designed to prevent overcompression beyond the material's plastic elasticity limits and therefore provides improved consistent removal efforts of the male blade at approximately three newtons.

Figure 6:
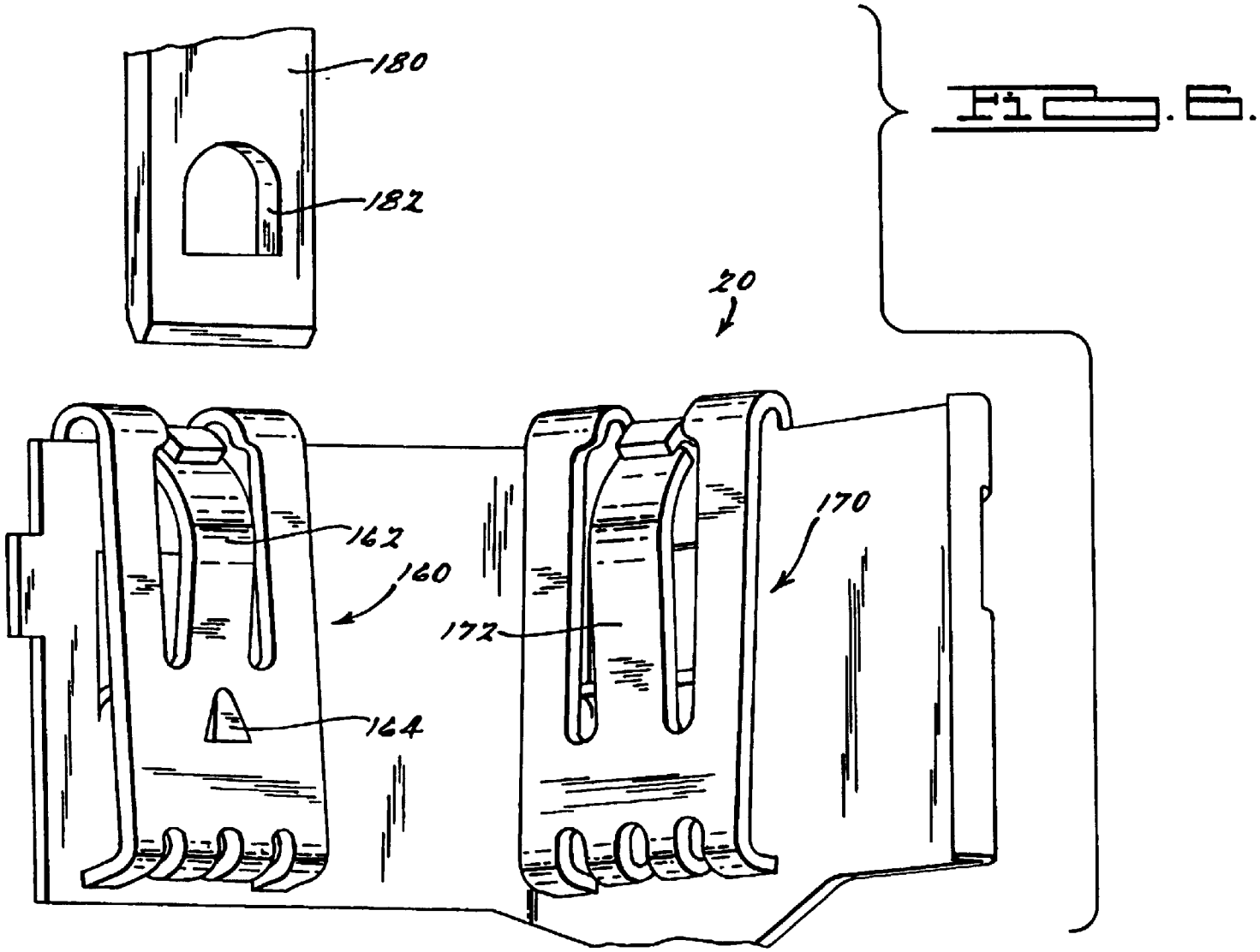
FIG. 6 is a partially unfolded perspective view showing an alternate embodiment of the present invention electrical terminal of FIG. 1.

An alternate embodiment of the present invention electrical terminal 20 is shown in FIG. 6. In this embodiment, electrical terminal 20 has a beam construction substantially similar to that of the preferred embodiment. However, one of the beams 160 has a tongue 162 of shortened longitudinal length. The beam 160 further has a pyramid-shaped locking formation 164 extending inwardly therefrom. The opposing beam 170 has a relatively longer tongue 172. A male member or blade 180 is insertable between beams 160 and 170. Male blade 180 has an aperture 182 cut therethrough for engaging with locking formation 164 upon full installation. Male blade 180 can be disengaged from locking formation 164 by insertion of a screw driver to outwardly compress beam 160. Of course, locking formation 164 can be employed in the preferred embodiment as well.

The present invention electrical terminal is advantageous over conventional constructions in that lower mating insertion efforts are achieved while preventing overcompression of the connector beams and inconsistent removal forces. This is achieved through the countering moment actions of the tongue and outboard shoulders. Additionally, overcompression is prevented by the incorporation of return stops and legs. The construction of the present invention provides for a greatly expanded useable temperature range of −40° Centigrade through 125° Centigrade without noticeable loss of performance. The return stops and lead-in bends also serve to prevent misaligned installation of a male blade and the traditional crushing of beams. Moreover, the specific design of each beam aids in male blade pullout creating a wiping movement upon each beam thereby removing oxidation and debris for improved electrical contact. The present invention electrical terminal is also advantageous over conventional connectors by providing a high electrical and mechanical contact area and a high point of initial contact. Furthermore, the present invention causes centering of the male blade between the beams. The electrical terminal of the present invention is sized to fit within standard fuse box or wire harness connector block cavities.

While the preferred embodiment of this electrical terminal has been disclosed, it will be appreciated that various modifications may be made without departing from the present invention. For example, an electrical connector may have a single beam with a tongue and outboard shoulders projecting longitudinally therefrom without a bend coupling it to a side wall. Furthermore, the beam of the present invention may be employed to retain fuses, metal frets, printed circuit board connectors, light bulbs or any other electric current carrying member. The beam construction of the present invention may also be flexibly coupled to any other electric current carrying member such as another box connector, metal fret, highly conducive printing circuit, rigid printed circuit board, deposit metal trace or flexible printed circuit board in place of the disclosed discrete wire. Additionally, the beam of the present invention electrical terminal may be used without return stops, return flanges and tongue retainers. The tongue and shoulders employed within the present invention may have alternate curved and straightened shapes thereto. Various materials have been disclosed in an exemplary fashion, however, a variety of other materials may of course be employed. It is intended by the following claims to cover these and any other departures from the disclosed embodiments which fall within the true spirit of this invention.

The invention claimed is:

1. An electrical terminal comprising:

an electrically conductive wall having a first end and a second end;

an electrically conductive beam having a first end and a second end;

a pair of first shoulders flexibly coupling said first end of said beam to said first end of said wall; and a tongue being flexibly coupled to said second end of said beam, said tongue extending generally toward said first end of said beam.

2. The electrical terminal of claim 1 further comprising:

a lead-in bend joining each of said shoulders of said beam to said wall.

3. The electrical terminal of claim 2 wherein said tongue protrudes beyond a plane defined by said shoulders opposite from said wall when in a nominal state thereof.

4. The electrical terminal of claim 3 further comprising:

a return stop located at said second end of said beam opposite from said first end of said beam, an edge of said return stop serving to abut against said wall to prevent over compression of said beam against said wall.

5. The electrical terminal of claim 2 further comprising:

a return leg flexibly joined to said second end of said beam opposite from said lead-in bends, said leg compressible against said wall for providing a shortened electrical path between said beam and said wall.

6. The electrical terminal of claim 5 further comprising:

an edge of said return leg pointing substantially toward said lead-in bends, a taper disposed along a lateral corner of said leg adjacent to said edge thereof.

7. The electrical terminal of claim 2 wherein said tongue is defined by a median portion, a recurved portion and a distal edge thereof, said distal edge of said tongue pointing substantially toward said wall.

8. The electrical terminal of claim 7 further comprising:

a tongue retainer joined to said wall between said lead-in bends, said tongue retainer covering said distal end of said tongue.

9. The electrical terminal of claim 1 further comprising:

a second beam;

a second wall; and a second pair of outboard shoulders flexibly coupling said second beam to said second wall in substantially mirrored symmetry to said first beam and said first wall.

10. The electrical terminal of claim 9 wherein said walls define portions of a box terminal.

11. The electrical terminal of claim 10 further comprising:

a tail extending from said first wall opposite from said lead-in bends thereof, said tail having tabs projecting therefrom which are crimpably attachable to a conductive wire, said conductive wire supplying electrical current to said tail which in turn supplies electrical current to said wall and said beam.

12. The electrical terminal of claim 9 wherein forces required to insert a male member between said beams are reduced as said male member fully engages said pair of outboard shoulders and said tongue of each as compared to when said male member initially only engages said tongue of each.

13. The electrical terminal of claim 1 further comprising:

a locking formation projecting from said beam for engagement with an aperture within a male blade insertable against said beam.

14. An electrical terminal comprising:

first and second electrically conductive walls defining portions of a box terminal; and a first electrically conductive beam flexibly coupled to said first wall, said beam having a pair of outboard shoulders and a tongue flexibly disposed therebetween, said tongue flexibly joined to said beam substantially opposite from where said beam is flexibly joined to said first wall, a lead-in bend joining each shoulder of said beam to said first wall, said tongue protruding beyond a plane defined by said shoulders opposite from said first wall when in a nominal state thereof, said tongue defined by a median portion, a recurved portion and a distal edge thereof, said distal edge of said tongue pointing substantially toward said first wall;

a second beam flexibly coupled to said second wall in substantially mirrored symmetry to said first beam and said first wall; and a tail extending from said first wall opposite from said lead-in bend thereof, said tail having tabs projecting therefrom which are crimpably attachable to a conductive wire;

whereby forces required to insert a male member between said beams are reduced as said male member fully engages said pair of outboard shoulders and said tongue of each as compared to when said male member initially only engages said tongue of each.

15. An electrical terminal comprising:

an electrically conductive wall;

an electrically conductive beam flexibly coupled to said wall;

a lead-in bend flexibly joining said beam to said wall;

a return stop located at a distal end of said beam opposite from said lead-in bend, an edge of said return stop serving to abut against said wall to prevent over compression of said beam against said wall; and a return leg flexibly joined to a distal end of said beam opposite from said lead-in bend, said leg compressible against said wall for providing a shortened electrical path between said beam and said wall.

16. The electrical terminal of claim 15 wherein said return stop is centrally disposed in a transverse direction providing transversely symmetrical loading of said beam.

17. The electrical terminal of claim 15 wherein there is a second return stop, said return stops being transversely disposed on either side of said beam.

18. An electrical terminal comprising:

an electrically conductive wall having a first end and a second end;

an electrically conductive beam having a first end and second end;

a pair of shoulders flexibly coupling said first end of said beam to said first end of said wall; and a tongue being flexibly coupled to said second end of said beam, said tongue extending generally toward said first end of said beam, wherein forces required to insert a male member against said beam are reduced as said male member fully engages said pair of shoulders and said tongue of said beam as compared to when said male member initially only engages said tongue.

* * * * *